US006357195B1

(12) United States Patent
Chen

(10) Patent No.: US 6,357,195 B1
(45) Date of Patent: Mar. 19, 2002

(54) SUPPORT FRAME OF SHEET PRODUCT

(76) Inventor: Chia-Ching Chen, No. 37-6, Erh Kan Rd., San Kan Village, Wai Pu Hsian, Taichung Hsien (TW)

( * ) Notice: Subject to any disclaimer, the term of this patent is extended or adjusted under 35 U.S.C. 154(b) by 0 days.

(21) Appl. No.: 09/515,936

(22) Filed: Feb. 29, 2000

(30) Foreign Application Priority Data

Nov. 25, 1999 (TW) ..... 88220068 U

(51) Int. Cl.[7] ..... E04C 2/42

(52) U.S. Cl. ..... 52/668; 52/646; 52/648.1; 52/653.1; 52/664; 52/650.3; 52/592.1; 52/590.2

(58) Field of Search ..... 52/633, 646, 648.1, 52/650.1, 653.1, 656.8, 664, 673, 675, 604, 605, 589.1, 590.1, 590.2, 592.1, 666, 667, 668; 446/82, 106, 108, 109, 112, 114, 115, 125, 127; 403/382, 217, 219

(56) References Cited

U.S. PATENT DOCUMENTS 3,813,841 A * 6/1974 Tsurumi ..... 46/27
5,185,982 A * 2/1993 Hostetler ..... 52/646
6,079,902 A * 6/2000 Pettee, Jr. ..... 403/35
6,189,271 B1 * 2/2001 Christensen ..... 52/233

* cited by examiner

*Primary Examiner*—Carl D. Friedman
*Assistant Examiner*—Yvonne M. Horton
(74) *Attorney, Agent, or Firm*—Browdy and Neimark PLLC

(57) ABSTRACT

A support frame is intended to support the decorative sheet product and is formed of a plurality of longitudinal elements and horizontal elements, which are in turn formed of a plurality of base portions and main bodies. The base portions are provided with a protrusion and a recess opposite in location to the protrusion, and two slots opposite in location to each other. The base portions are joined together by the mortise-tenon joints to form the longitudinal elements. The main bodies are provided with two protruded blocks opposite in location to each other and are arranged in alignment such that the protruded blocks are received in the slots of the base portions of the longitudinal elements, and that the main bodies form the horizontal elements perpendicular to the longitudinal elements.

2 Claims, 2 Drawing Sheets

SUPPORT FRAME OF SHEET PRODUCT

FIELD OF THE INVENTION

The present invention relates generally to a decorative product, and more particularly to a support frame of the decorative sheet product.

BACKGROUND OF THE INVENTION

The construction of a ceiling makes us of a support frame which is fastened with the top of a structure for supporting the ceiling sheet product in conjunction with the fastening nails. The use of the conventional support frame results in a substantial decrease in the space between the ceiling and the floor. In addition, the conventional support frame takes up a large storage space.

SUMMARY OF THE INVENTION

The primary objective of the present invention is to provide the decorative sheet product with a support frame free from the deficiencies of the conventional support frame described above.

In keeping with the principle of the present invention, the foregoing objective of the present invention is attained by a support frame comprising a plurality of longitudinal elements and horizontal elements perpendicular to the longitudinal elements. Each longitudinal element has a base portion which is provided with two slots opposite to each other and extending along the direction of the longitudinal axis of the base portion. The base portion is provided at one end thereof with a protrusion, and at other end thereof with a recess 28 complementary in shape to the protrusion. Each horizontal element has a main body which is provided at both ends thereof with a protruded block. The longitudinal elements and the horizontal elements are joined together to form the support frame in conjunction with the protrusion and the recess of the longitudinal elements, the protruded block of the horizontal elements, and the slots of the longitudinal elements.

DETAILED DESCRIPTION OF THE INVENTION

Figure 1:
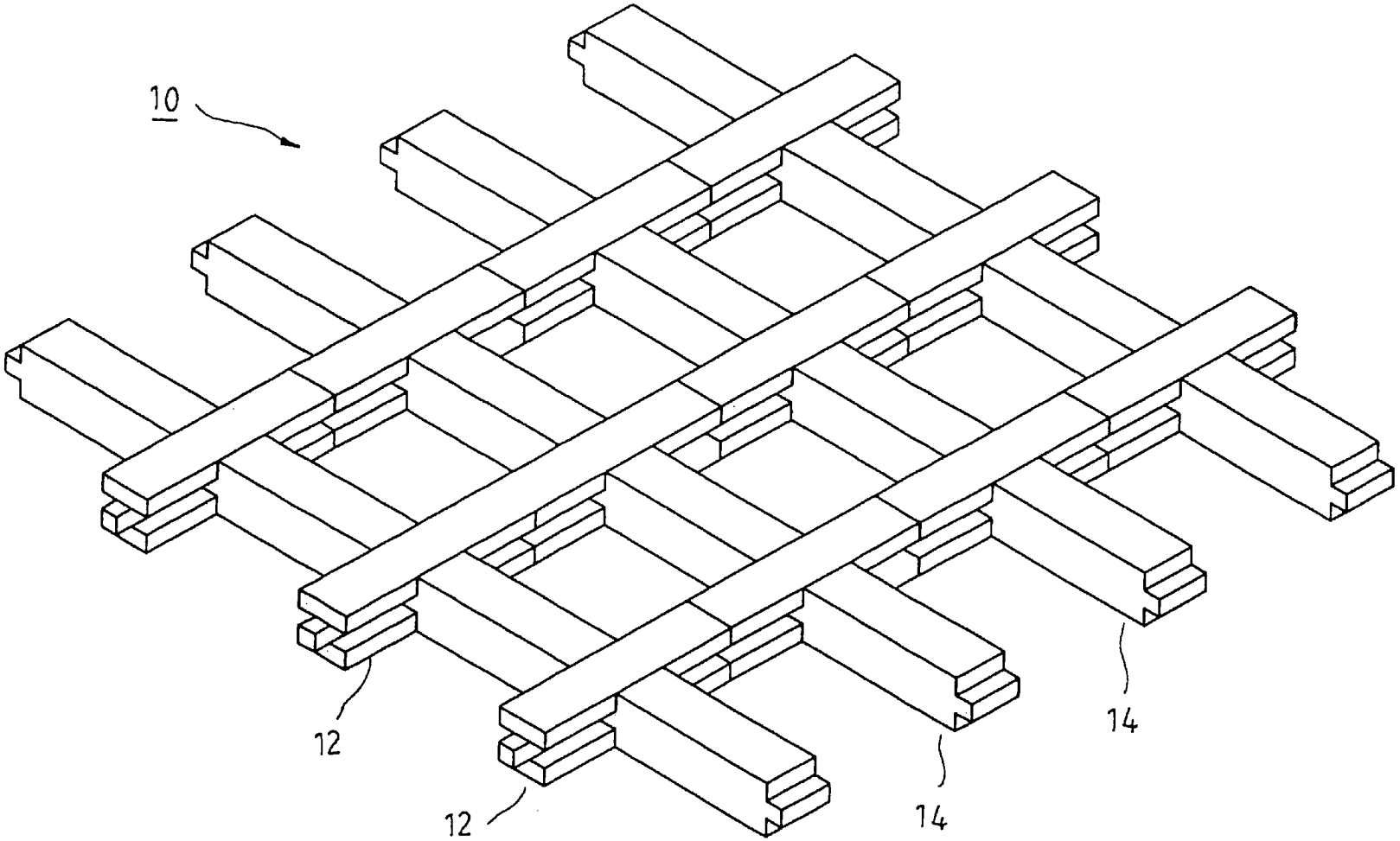
FIG. 1 shows a perspective view of a preferred embodiment of the present invention.
Figure 2:
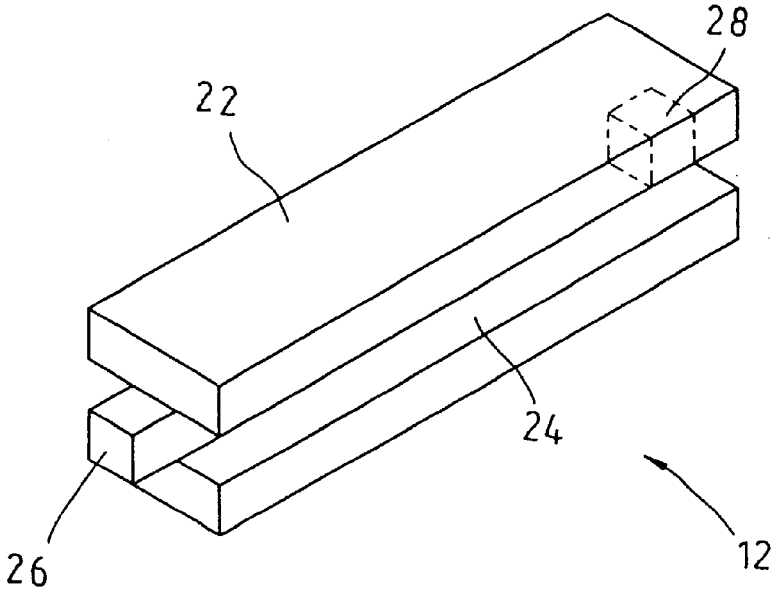
FIG. 2 shows a perspective view of a longitudinal element of the preferred embodiment of the present invention.
Figure 3:
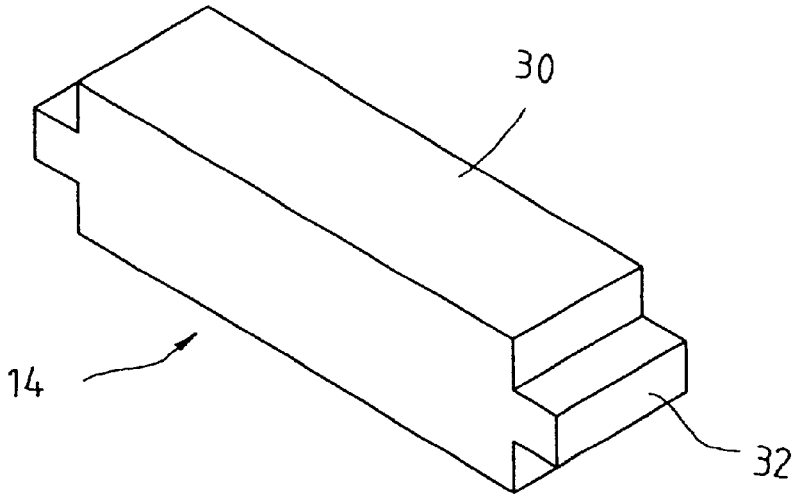
FIG. 3 shows a perspective view of a horizontal element of the present invention.

As shown in all drawings provided herewith, a support frame 10 of the present invention is used in supporting the decorative sheet product and is formed of a plurality of longitudinal elements 12 and horizontal elements 14 perpendicular to the longitudinal elements 12. The longitudinal elements 12 are provided with a base portion 22 which is provided in two opposite longitudinal sides thereof with a slot 24 of a length and extending along the direction of the longitudinal axis of the base portion 22. The base portion 22 is further provided at one longitudinal end thereof with a protrusion 26, and at other longitudinal end thereof with a recess 28 complementary in shape to the protrusion 26. The horizontal elements 14 are provided with a rectangular main body 30 which is in turn provided at both longitudinal ends thereof with a protruded block 32 complementary in shape to the slot 24. The main body 30 is corresponding in thickness to the base portion 22.

The support frame 10 of the present invention is formed of a plurality of the longitudinal elements 12 and the horizontal elements 14. Each longitudinal element 12 is formed of a plurality of base portions 22, which are joined together end to end such that the protrusion 26 of one base portion 22 is received in the recess 28 of another base portion 22. Each horizontal element 14 is formed of a plurality of the main bodies 30 which are arranged in alignment with one another and are perpendicular to the longitudinal elements 12 such that the protruded blocks 32 of the main bodies 30 are received in the slots 24 of the base portions 22 of the longitudinal elements 12.

Both longitudinal elements 12 and the horizontal elements 14 of the support frame 10 of the present invention are formed of a plurality of building blocks, such as the base portions 22 and the main bodies 30. As a result, the support frames 10 of various specifications can be constructed on the construction site. In addition, the base portions 22 and the main bodies 30 can be easily stored or shipped.

The longitudinal elements 12 and the horizontal elements 14 of the present invention are formed of building blocks by the mortise-tenon joints, which may be further reinforced by the fastening nails (not shown in the drawings).

The embodiment of the present invention described above is to be regarded in all respects as being merely illustrative and not restrictive. Accordingly, the present invention may be embodied in other specific forms without deviating from the spirit thereof. For example, the cross-sectional shapes of the protrusion 26, the recess 28, the slot 24, and the protruded block 32 of the present invention may be rectangular or of any geometric form. The present invention is therefore to be limited only by the scopes of the following appended claims.

What is claimed is:

1. A support frame of a construction sheet product, said support frame comprising a plurality of longitudinal elements and horizontal elements perpendicular to said longitudinal elements, said longitudinal elements being formed of a plurality of base portions, with each base portion having two longitudinal sides and two longitudinal ends, each of said longitudinal sides being provided with a slot, one of said longitudinal ends being provided with a protrusion, and the other of said longitudinal ends being provided with a recess complementary in shape to said protrusion, whereby said base portions are joined together end to end such that said protrusion of one of said base portions is received in said recess of another one of said base portions, said horizontal elements being formed of a plurality of main bodies, with each having two protruded blocks complementary in shape to said slots of said base portions, said main bodies being arranged in alignment such that said protruded blocks of each of said main bodies are received in said slots of said base portions, and wherein said protrusion and said recess of each of said base portions are located at the center of the longitudinal ends of each of said base portions.

2. The support frame as defined in claim 1, wherein said protrusions, said recesses, said slots, and said protruded blocks have a rectangular cross section.

* * * * *